US008305331B2

(12) United States Patent
Rumreich

(10) Patent No.: US 8,305,331 B2
(45) Date of Patent: Nov. 6, 2012

(54) LCD DEVICE POWER SAVING SYSTEM AND METHOD OF REDUCING POWER CONSUMPTION OF LCD DEVICE

(75) Inventor: Mark F. Rumreich, Indianapolis, IN (US)

(73) Assignee: TTE Indianapolis, Indianapolis, IN (US)

( * ) Notice: Subject to any disclaimer, the term of this patent is extended or adjusted under 35 U.S.C. 154(b) by 1515 days.

(21) Appl. No.: 11/826,316

(22) Filed: Jul. 13, 2007

(65) Prior Publication Data

US 2009/0015538 A1 Jan. 15, 2009

(51) Int. Cl.
*G09G 3/36* (2006.01)

(52) U.S. Cl. ..... 345/102; 345/99; 345/211; 362/97.1; 713/320

(58) Field of Classification Search ..... 345/87, 345/99, 102, 211; 349/61–65; 362/97.1–97.3; 713/300–340
See application file for complete search history.

(56) References Cited

U.S. PATENT DOCUMENTS 5,437,040 A * 7/1995 Campbell et al. ..... 713/340
5,815,407 A * 9/1998 Huffman et al. ..... 702/57
5,854,617 A * 12/1998 Lee et al. ..... 345/102
6,175,353 B1 * 1/2001 Hoeksma ..... 345/102
6,278,887 B1 * 8/2001 Son et al. ..... 455/566
6,404,145 B1 * 6/2002 Saito ..... 315/307
6,426,736 B1 * 7/2002 Ishihara ..... 345/102
6,731,958 B1 * 5/2004 Shirai ..... 455/574
6,762,742 B2 * 7/2004 Moon et al. ..... 345/102
2005/0052446 A1 * 3/2005 Plut ..... 345/211
2007/0291023 A1 * 12/2007 Ohata ..... 345/211

OTHER PUBLICATIONS

W-C, Cheng and M. Pedram, "Power Minimization in Backlit TFT-LCD Display by Concurrent Brightness and Contrast Scaling," Proc. of Design Automation and Tests in Europe, Feb. 2005, pp. 252-259.

* cited by examiner

*Primary Examiner* — Joe H Cheng
(74) *Attorney, Agent, or Firm* — Morgan, Lewis & Bockius LLP

(57) ABSTRACT

A control system for a portable display device includes a battery power supply powering a display panel of the portable display device, a backlight controller and a video processor connected to the display panel for displaying images, an adaptive controller providing output signals to the backlight controller and the video processor, a video analyzer providing a first input to the adaptive controller, and a remaining display time estimator providing a second input to the adaptive controller, wherein the remaining display time estimator determines a remaining display time of the portable display device and controls the adaptive controller to adjust one of the backlight controller and the video processor based upon the determined remaining display time.

17 Claims, 2 Drawing Sheets

LCD DEVICE POWER SAVING SYSTEM AND METHOD OF REDUCING POWER CONSUMPTION OF LCD DEVICE

BACKGROUND OF THE INVENTION

1. Field of the Invention

The present invention relates to a display device. More specifically, the present invention relates to a liquid crystal display (LCD) device capable of reducing power consumption and a method of reducing power consumption of an LCD device.

2. Discussion of the Related Art

In general, portable LCD devices are commonly operated using batteries, and therefore, have a limited playing time. Accordingly, conserving battery power is especially important in order to provide the longest possible playing time of the LCD device for a given battery capacity. Alternatively, conservation of battery power allows for a smaller battery capacity of a given playing time of the LCD device.

LCD devices commonly make use of backlight units to provide light for viewing images on a display panel. However, as much as one-half of the power consumed by an LCD device is from use of the backlight unit. Accordingly, most LCD devices use various techniques to reduce power consumption of the backlight unit. For example, laptop computers may automatically reduce the output (i.e., brightness) of the backlight unit after a certain period of inactivity. Moreover, laptop computers, as well as LCD television displays, may reduce the brightness of the backlight unit in response to low ambient light levels at the viewing location of the laptop computer or LCD television display.

Although many different techniques have been developed to extend the playing time of the portable LCD devices, most techniques strive to reduce power consumption of the backlight unit. These techniques include simultaneously reducing the brightness of the backlight unit and modification of transfer characteristics of the video path in order to reduce or minimize degradation of images displayed on the display panel, such as perceived loss of image brightness and image contrast. An example of this technique is described by W-C. Cheng and M. Pedram in "Power Minimization in a Backlit TFT-LCD Display by Concurrent Brightness and Contrast Scaling," Proc. of Design Automation and Test in Europe, February 2005, pp. 252-259.

However, these various techniques for extending the playing time of portable LCD devices fail to consider conserving more power as battery charge diminishes. Accordingly, an improved technique is required that dynamically conserves power of portable LCD devices.

SUMMARY OF THE INVENTION

Accordingly, the present invention is directed to an LCD device power saving system and method of reducing power consumption of LCD devices that substantially obviates one or more of the problems due to limitations and disadvantages of the related art.

An object of the present invention is to provide a portable display device that provides for reducing power consumption.

Another object of the present invention is to provide a portable display device having variable power consumption.

Another object of the present invention is to provide a method of reducing power consumption of a portable display device.

Additional features and advantages of the invention will be set forth in the description which follows and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a control system for a portable display device includes a battery power supply powering a display panel of the portable display device, a backlight controller and a video processor connected to the display panel for displaying images, an adaptive controller providing output signals to the backlight controller and the video processor, a video analyzer providing a first input to the adaptive controller, and a remaining display time estimator providing a second input to the adaptive controller, wherein the remaining display time estimator determines a remaining display time of the portable display device and controls the adaptive controller to adjust one of the backlight controller and the video processor based upon the determined remaining display time.

In another aspect, a portable display device includes a display panel, a battery power supply powering a display panel of the portable display device, an adaptive controller providing output signals to control the display panel, a video analyzer providing a first input to the adaptive controller, and a remaining display time estimator providing a second input to the adaptive controller to adjust a display of images on the display panel based upon a determination of a remaining display time of the portable display device.

In another aspect, a method of reducing power consumption of a portable display device includes powering a display panel of the portable display device with a battery power supply to display images of a video program, determining a remaining display time of the portable display device based upon the battery power supply, and adjusting the display images on the display panel based upon the remaining display time.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principles of the invention. In the drawings.

DETAILED DESCRIPTION OF THE PREFERRED EMBODIMENTS

Reference will now be made in detail to the illustrated embodiments of the present invention, examples of which are illustrated in the accompanying drawings.

Figure 1:
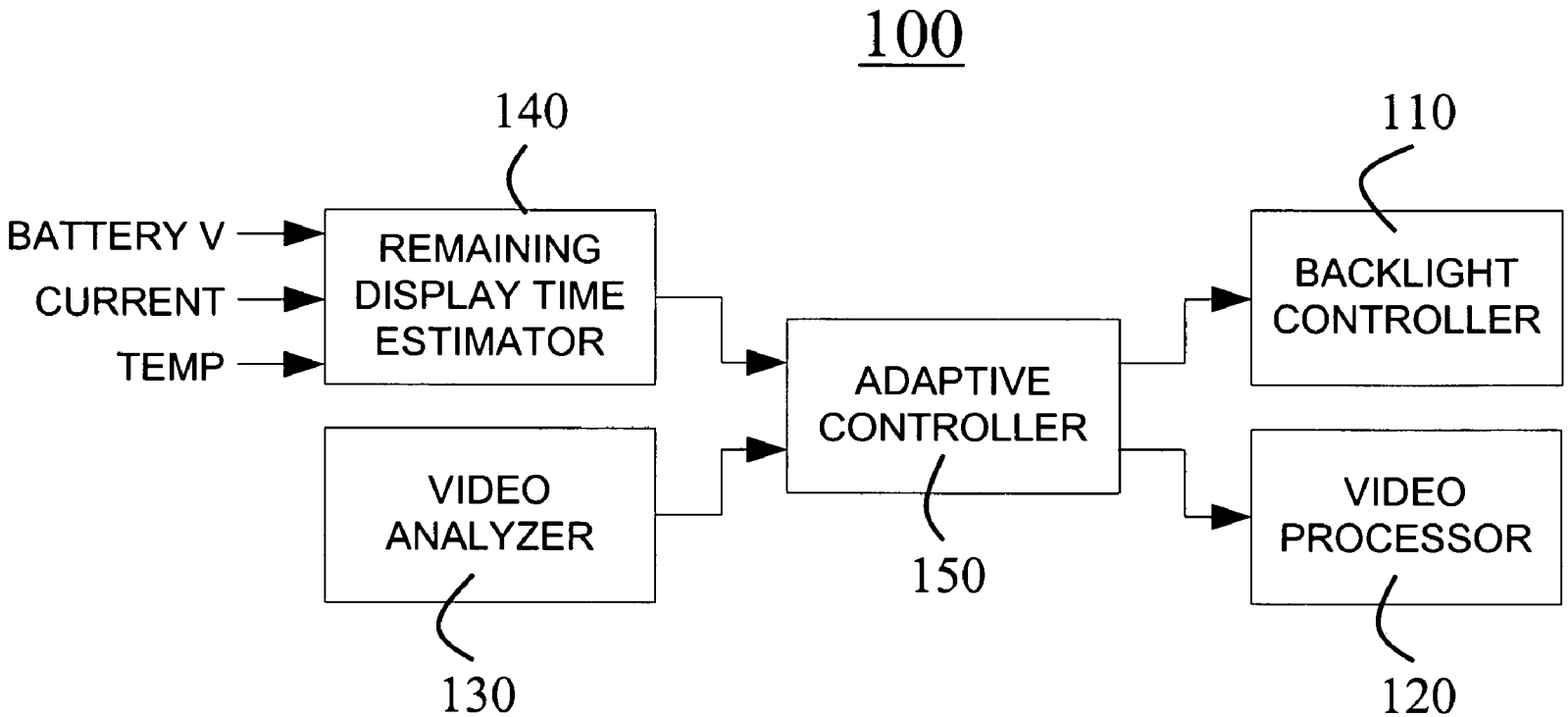
FIG. 1 is a schematic diagram of an exemplary control system for a display device according to the present invention.

FIG. 1 is a schematic diagram of an exemplary control system for a portable display device according to the present invention. In FIG. 1, a control system 100 makes use of an estimator to determine remaining time for viewing images on a display panel (not shown), and includes a BACKLIGHT CONTROLLER 110 and a VIDEO PROCESSOR 120 connected to a VIDEO ANALYZER 130 and a REMAINING DISPLAY TIME ESTIMATOR 140 via an ADAPTIVE CONTROLLER 150. Here, the ADAPTIVE CONTROLLER 150 receives video signals from the VIDEO ANALYZER 130 and input signals from the REMAINING DISPLAY TIME ESTIMATOR 140 to adjust output of a backlight unit (not shown), which may correspond to image brightness, that is connected to the BACKLIGHT CONTROLLER 110 and to adjust output of the display panel, which may correspond to image quality, that is connected to the VIDEO PROCESSOR 120. For example, the VIDEO ANALYZER 130 may generate a video luminance histogram in order to determine an amount by which to reduce output of the backlight unit for a specific image quality. Accordingly, adjustments of the backlight unit and the display panel are dependent upon an estimated remaining display time determined by the REMAINING DISPLAY TIME ESTIMATOR 140. Thus, if a sporting event is being broadcast or is being replayed from a recorded program on the display panel, and the power being supplied to the portable display device is determined to be almost depleted, the portable display device may reduce image brightness and/or image quality to ensure that the ending of the sports event may be successfully seen by the viewer. In addition, the portable display device may reduce audio quality (i.e., tone) or audio volume to ensure that the ending of the sports event may be successfully seen by the viewer.

In FIG. 1, the REMAINING DISPLAY TIME ESTIMATOR 140 may use various parameters for determining an amount of time remaining for displaying images on the display panel (not shown) including battery voltage of a battery (not shown) used to power the portable display panel/device, current consumption of the battery powering the portable display panel/device, and/or ambient temperature conditions of the battery. In addition, the REMAINING DISPLAY TIME ESTIMATOR 140 may use parameters related to a rate of usage of the battery since a most recent full charging, the operational age of the battery, and/or the current capacity of the battery. For example, the REMAINING DISPLAY TIME ESTIMATOR 140 may determine that the rate of usage of the battery includes amp-hours of use or hours of use since the last full charging of the battery. In addition, the REMAINING DISPLAY TIME ESTIMATOR 140 may determine that the operational age of the battery includes a total number of charge/discharge cycles the battery has undergone or a total running time of the battery since its last full charge. Here, the REMAINING DISPLAY TIME ESTIMATOR 140 determines the rate of usage of the battery to establish battery quality to determine how efficiently the battery will deliver a specific amount of current and/or a specific rate at which battery current may be delivered.

In FIG. 1, when the display device (not shown) is powered using an AC power source or is powered by another constant power source, such as an automobile adapter, rather than a battery, the control system 100 reverts to an operational mode such that operational parameters of the display device are set to provide high quality images. Accordingly, the VIDEO ANALYZER 130 may be directly interconnected with the BACKLIGHT CONTROLLER 110 and the VIDEO PROCESSOR 120 since the AC power source, or constant power source, for the display device is virtually unlimited. Thus, since determining the various parameters of the battery may not be necessary, the REMAINING DISPLAY TIME ESTIMATOR 140 may be disabled or bypassed.

Figure 2:
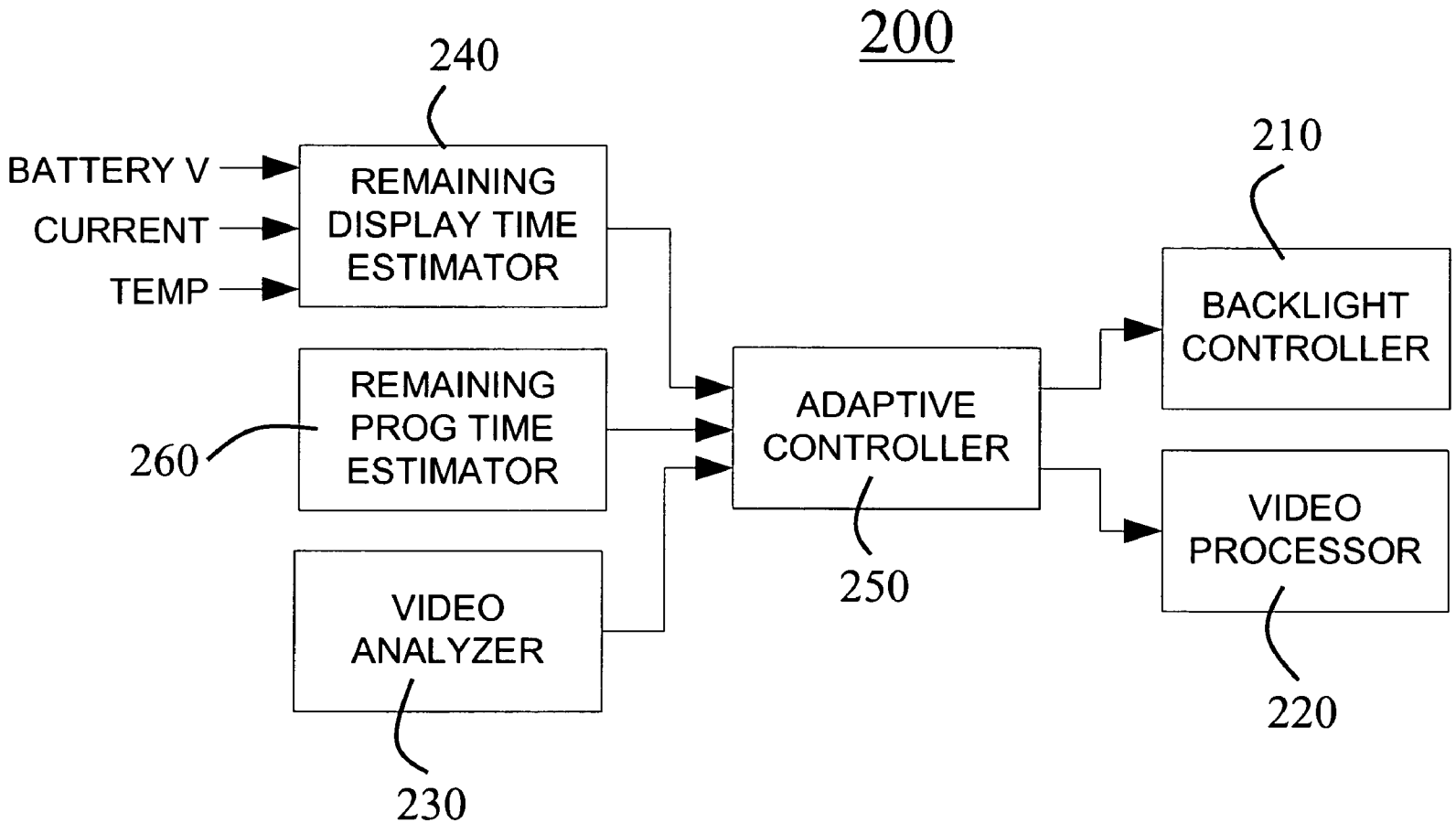
FIG. 2 is a schematic diagram of another exemplary control system for a display device according to the present invention.

FIG. 2 is a schematic diagram of another exemplary control system for a portable display device according to the present invention. In FIG. 2, a control system 200 makes use of an estimator to determine remaining time for viewing images on a display panel (not shown) and an estimator to determine remaining time of a recorded or televised program, and includes a BACKLIGHT CONTROLLER 210 and a VIDEO PROCESSOR 220 connected to a VIDEO ANALYZER 230, a REMAINING DISPLAY TIME ESTIMATOR 240, and a REMAINING PROGRAM TIME ESTIMATOR 260 via an ADAPTIVE CONTROLLER 250. Here, the ADAPTIVE CONTROLLER 250 receives video signals from the VIDEO ANALYZER 230, input signals from the REMAINING DISPLAY TIME ESTIMATOR 240, and input signals from the REMAINING PROGRAM TIME ESTIMATOR 260 to adjust output of a backlight unit (not shown), which corresponds to image brightness, that is connected to the BACKLIGHT CONTROLLER 210 and to adjust output of the display panel, which corresponds to image quality, that is connected to the VIDEO PROCESSOR 220. For example, the VIDEO ANALYZER 230 may generate a video luminance histogram in order to determine an amount by which to reduce output of the backlight unit for a specific image quality. Accordingly, adjustments of the backlight unit and the display panel are dependent upon an estimated remaining display time determined by the REMAINING DISPLAY TIME ESTIMATOR 240 and the remaining time of a recorded program by the REMAINING PROGRAM TIME ESTIMATOR 260. Thus, if a sporting event is being broadcast or is being replayed from a recorded program on the display panel, and the power being supplied to the portable display device is almost depleted, the portable display device may reduce image brightness and/or image quality to ensure that the ending of the sports event or the recorded program may be successfully seen by the viewer. In addition, the portable display device may reduce audio quality, i.e., tone, or audio volume to ensure that the ending of the sports event may be successfully seen by the viewer.

In FIG. 2, the REMAINING DISPLAY TIME ESTIMATOR 240 may use various parameters for determining an amount of time remaining for displaying images on the display panel (not shown) including battery voltage of a battery (not shown) used to power the portable display panel/device, current consumption of the battery powering the portable display device, and/or ambient temperature conditions of the battery. In addition, the REMAINING DISPLAY TIME ESTIMATOR 240 may use parameters related to an amount of time the battery has been used since a most recent full charging, the age of the battery, and/or the current capacity of the battery. For example, the REMAINING DISPLAY TIME ESTIMATOR 140 may determine that the rate of usage of the battery includes amp-hours of use or hours of use since the last full charging of the battery. In addition, the REMAINING DISPLAY TIME ESTIMATOR 140 may determine that the operational age of the battery includes a total number of charge/discharge cycles the battery has undergone or a total running time of the battery since its last full charge. Here, the REMAINING DISPLAY TIME ESTIMATOR 140 determines the rate of usage of the battery to establish battery quality to determine how efficiently the battery will deliver a specific amount of current and/or a specific rate at which battery current may be delivered.

In FIG. 2, the REMAINING PROGRAM TIME ESTIMATOR 260 may use various parameters for determining an amount time remaining for the recorded or televised program. For example, the REMAINING PROGRAM TIME ESTIMATOR 260 may determine that a recorded program stored on a DVD has 35 minutes until the end of the recorded program (or until some predetermined event on the DVD, such as display of production credits, outtakes, trailers, etc.). As another example, the REMAINING PROGRAM TIME ESTIMATOR 260 may determine that a broadcast program (not only broadcast over the air, but provided via direct input, such as cable or satellite TV) has 20 minutes until the end of the scheduled broadcast by use of program guide information included with the transmission of the broadcast. In either of these events, the ADAPTIVE CONTROLLER 250 may receive input from the REMAINING DISPLAY TIME ESTIMATOR 240 and the REMAINING PROGRAM TIME ESTIMATOR 260 to advantageously control a backlight power reduction system (not shown), or the BACKLIGHT CONTROLLER 210 directly, in order to allow completion of the recorded or broadcast program by reducing output of the backlight unit. Of course, other operational features of the display device may be controlled including volume, color, tint, and contrast, but since the backlight unit and video processor consume relatively greater proportions of input power, none of these other operational features are explicitly shown as being controlled.

Although not shown, the control systems 100 and 200 of FIGS. 1 and 2, respectively, may further display functional operations of the display device to a user on the display panel during operation of the display device. For example, the displayed functional operations may include the estimated remaining display time determined by the REMAINING DISPLAY TIME ESTIMATOR and/or the estimated remaining program time determined by the REMAINING PROGRAM TIME ESTIMATOR. These displayed functional operations may be presented as actual units of time or as relative numerical percentages.

It will be apparent to those skilled in the art that various modifications and variations can be made in the LCD device power saving system and method of reducing power consumption of LCD devices of the present invention without departing from the spirit or scope of the inventions. Thus, it is intended that the present invention covers the modifications and variations of this invention provided they come within the scope of the appended claims and their equivalents.

What is claimed is:

1. A control system for a portable display device, comprising:

a battery power supply powering a display panel of the portable display device;

a backlight controller and a video processor connected to the display panel for displaying images;

an adaptive controller providing output signals to the backlight controller and the video processor;

a video analyzer providing a first input to the adaptive controller;

a remaining display time estimator providing a second input to the adaptive controller; and a remaining program time estimator providing a third input to the adaptive controller, the remaining program time estimator determines a remaining program display time of one of a broadcast program and recorded program for displaying the images on the portable display device, wherein the remaining display time estimator determines a remaining display time of the portable display device and controls the adaptive controller to adjust one of the backlight controller and the video processor based upon the determined remaining display time.

2. The system according to claim 1, wherein the remaining display time is determined based upon one of voltage of the battery power supply, current consumption of the battery power supply, and ambient temperature of the battery power supply.

3. The system according to claim 1, wherein the remaining display time is determined based upon one of usage rate of the battery power supply since the most recent full charge of the battery power supply, operational age of the battery power supply, and current capacity of the battery power supply.

4. The system according to claim 1, wherein the remaining program time estimator further controls the adaptive controller to adjust one of the backlight controller and the video processor based upon the determined remaining program display time.

5. The system according to claim 4, wherein the adaptive controller adjusts one of image brightness, image quality, and audio quality.

6. A portable display device, comprising:

a display panel;

a battery power supply powering a display panel of the portable display device;

an adaptive controller providing output signals to control the display panel;

a video analyzer providing a first input to the adaptive controller;

a remaining display time estimator providing a second input to the adaptive controller to adjust a display of images on the display panel based upon a determination of a remaining display time of the portable display device; and a remaining program time estimator that determines a remaining program display time of one of a broadcast program and recorded program for displaying the images on the display panel.

7. The device according to claim 6, wherein the determination of a remaining display time is based upon one of voltage of the battery power supply, current consumption of the battery power supply, and ambient temperature of the battery power supply.

8. The device according to claim 7, wherein the determination of a remaining display time is based upon one of usage rate of the battery power supply since the most recent full charge of the battery power supply, operational age of the battery power supply, and current capacity of the battery power supply.

9. The device according to claim 6, wherein the remaining program time estimator further controls the adaptive controller to adjust the images on the display panel based upon the determined remaining program display time.

10. The device according to claim 9, wherein the adaptive controller adjusts one of image brightness, image quality, and audio quality.

11. The device according to claim 10, wherein the image quality includes one of color, tint, and contrast, and the audio quality includes one of tone and volume.

12. A method of reducing power consumption of a portable display device, comprising:

powering a display panel of the portable display device with a battery power supply to display images of a video program;

determining a remaining display time of the portable display device based upon the battery power supply;

adjusting the display images on the display panel based upon the remaining display time; and determining a remaining program time of the video program and adjusting the display images on the display panel based upon the remaining program time.

13. The method according to claim 12, wherein the remaining display time is based upon one of voltage of the battery power supply, current consumption of the battery power supply, and ambient temperature of the battery power supply.

14. The method according to claim 12, wherein the remaining display time is based upon one of usage rate of the battery power supply since the most recent full charge of the battery power supply, operational age of the battery power supply, and current capacity of the battery power supply.

15. The method according to claim 12, wherein the adjusting the display images includes adjusting one of a backlight controller and a video processor.

16. The method according to claim 15, wherein the adjusting the display images includes adjusting one of brightness of the display images, quality of the display images, and audio of the display images.

17. The method according to claim 16, wherein the quality of the display images includes one of color, tint, and contrast, and the audio of the display images includes one of tone and volume.

* * * * *